US006092679A

United States Patent [19]

Wurzer et al.

[11] Patent Number: 6,092,679

[45] Date of Patent: Jul. 25, 2000

[54] SUPPORT HOUSING FOR LIGHTWEIGHT DRAWBAR ASSEMBLY

[75] Inventors: Jeffrey D. Wurzer, Turtle Creek; Shawn A. Opfer, Pittsburgh, both of Pa.

[73] Assignee: McConway & Torley Corporation, Pittsburgh, Pa.

[21] Appl. No.: 09/154,610

[22] Filed: Sep. 17, 1998

[51] Int. Cl.[7] ..... B61G 9/20

[52] U.S. Cl. ..... 213/62 R; 213/50; 213/61; 213/62 A

[58] Field of Search ..... 213/62 R, 69, 213/72, 50, 50.5, 61, 75 R, 62 A, 67 A, 67 R

[56] References Cited

U.S. PATENT DOCUMENTS 4,456,133 6/1984 Altherr et al. ..... 213/62 R
4,580,686 4/1986 Elliott ..... 213/62 A
5,201,827 4/1993 Glover et al. ..... 213/61
5,558,238 9/1996 Daugherty et al. ..... 213/50.5
5,598,937 2/1997 Clark ..... 213/62 R

*Primary Examiner*—S. Joseph Morano
*Assistant Examiner*—Lars A. Olson
*Attorney, Agent, or Firm*—James Ray & Associates

[57] ABSTRACT

A support housing for supporting a slackless drawbar coupler assembly within a center sill of a railway car, in which the slackless drawbar assembly has a drawbar pivotally attached within a spool by a pivot pin, the support housing including a generally rectangular three-dimensional body having a generally rectangular, three-dimensional cavity in an underside surface, a forward end wall and a pair of generally parallel side wall portions with a pair of opposed and axially aligned apertures through the generally parallel side wall portion of the cavity, each aperture adapted to receive a disk pin insertable therethrough and also insertable through one each of a second pair of opposed and axially aligned apertures through parallel side walls of the spool, such that said spool is pivotal within said cavity on the axially aligned disk pins.

18 Claims, 3 Drawing Sheets

SUPPORT HOUSING FOR LIGHTWEIGHT DRAWBAR ASSEMBLY

CROSS REFERENCE TO RELATED APPLICATIONS

The invention taught in this patent application is closely related to the inventions taught in four co-pending patent applications, namely: LIGHTWEIGHT DRAWBAR ASSEMBLY, Ser. No. 09/154,792, SPOOL FOR LIGHTWEIGHT DRAWBAR ASSEMBLY, Ser. No. 09/156,304, BEARING BLOCK FOR LIGHTWEIGHT DRAWBAR ASSEMBLY, Ser. No. 09/154,852, DRAWBAR FOR LIGHTWEIGHT DRAWBAR ASSEMBLY, Ser. No. 09/156,542, all of which are being filed concurrently herewith. These patent applications are assigned to the assignee of this invention, and the teachings therein are incorporated into this application by reference thereto.

FIELD OF THE INVENTION

The present invention relates, in general, to drawbar assemblies for interconnecting railway cars. More particularly, his invention relates to a new and improved support housing for use within a drawbar assembly, which support housing is adapted to receive and pivotally support a unique spool structure such that the spool structure is retained for pivotal movement in a defined plane. The pivotal movement of the spool in the defined plane in combination with the pivotal movement of the drawbar within the spool in a plane perpendicular to the defined plane permits the combination to function like a universal joint to better maintain a completely slackless arrangement to the assembly, and furthermore, achieve a structure that is lighter in weight and stronger than prior art drawbar assemblies.

BACKGROUND OF THE INVENTION

In 1932, the Type E coupler was adopted as the ARA, American Railway Association (predecessor to the AAR, Association of American Railroads) standard coupler for railway freight cars. Although modified periodically since then to meet changing requirements imposed by changing demands, and other coupler designs have been developed for special applications, the Type E coupler is today still the standard coupler for freight service. As is well known, the Type E coupler as well as other standard use couplers, have a degree of free and cushioned slack. That is, a certain amount of free "play" exists between the coupler components when the load is changed from draft to buff loading, and visa versa. At the same time, the draft gear acts as a spring mechanism to cushion impact between adjacent cars. It has been found that eliminating the free and cushioned slack within a train can eliminate over the road train action forces due to "run-ins" and "run-outs". The magnitude of these forces are large and cause significant wear and tear of the rolling stock, and in some cases can be significant enough to cause derailments.

More recently, slackless drawbar couplers have come into use which were developed for use in unit train applications where interconnected cars are uncoupled only rarely for periodic inspection and repair, with the coupling essentially comprising a rigid drawbar with one end pivotally connected to one car and the other end pivotally connected to the adjacent car. Such jointed cars are not subjected daily to impact forces associated with bumping encountered in classification yards, and, therefore, do not require cushioning devices such as draft gears. Accordingly, because of their significant lighter weight, such slackless drawbar couplers are in widespread use in unit trains, such as coal trains, and other captive use applications.

An example of such a slackless drawbar coupling is disclosed in U.S. Pat. No. 4,580,686, the disclosure of which is incorporated herein by reference. This patented coupling system provides a drawbar arrangement for coupling railway cars each having a center sill and trucks at its opposite ends, the trucks being pivotal about vertical king pins. The drawbar has an enlarged spherical butt end portion defining essentially convex spherical buff and draft load surfaces, a rear support block having a tapered rear surface and a concave substantially hemispherical buff load bearing surface adapted to engage with the convex buff load bearing surface of the butt end portion of the drawbar, a slack adjusting wedge for engaging the tapered surface of the rear support block, means for transferring buff loads from the slack adjusting wedge to the center sill, a front draft block having a concave and substantially hemispherical draft load bearing surface adapted to engage with the convex draft load surface of the enlarged spherical butt end portion, the front draft block including an annular draft load surface opposite the hemispherical draft load surface thereof, a wear block having an annular draft load surface adapted to engage the annular draft load surface of the front draft block, and means supported by the center sill for transferring a draft load from the wear block to the center sill. Although there are other slackless drawbar designs, most can be divided into two basic types, those in which the drawbar is rotary, as described above where the drawbar has a spherical head portion, and those where the drawbar is not rotary, as for example, where the end of the drawbar is secured with a single pivot pin securing it to a base structure.

The above cited co-pending application titled "LIGHTWEIGHT DRAWBAR ASSEMBLY", Ser. No. 09/154,792, teaches a unique new and improved slackless drawbar assembly of the non-rotary type, which meets all AAR specifications, is significantly lighter in weight and yet stronger than prior art drawbar systems, and is virtually slack free.

SUMMARY OF THE INVENTION

This invention is predicated on a unique support housing as may be utilized in that new and improved drawbar assembly, which support housing provides a cavity adapted to receive a unique spool structure such that the spool structure is pivotal in a defined plane. Since the drawbar is pivotal in a plane perpendicular to he defined plane in which the spool is pivotal, the combination of support housing and spool function like a universal joint to permit a virtually slack-fee pivotal movement of the drawbar in any direction.

In essence, the unique and improved slackless drawbar system itself, like other slackless drawbar systems, is adapted for use in combination with railway cars having a center sill, and is incorporated into the center sill. The assembly includes a drawbar having a shank portion extending to an enlarged truncated butt end portion defining essentially a convex, partial hemispherical buff load bearing surface, with an aperture at the axis of the partial hemispherical buff load bearing surface, with the shank portion projecting from the convex, partial hemispherical buff load bearing surface. The drawbar of this invention is unique in that it is provided with a generally rectangular aperture through which the pivot pin is insertable, such rectangular aperture adapted to receive a unique generally rectangular bearing block having a concave, cylindrical surface on one side adapted to engage a side of the pivot pin, and having a flat surface opposite the concave, cylindrical surface which is adapted to abut against a flat wall surface of the generally rectangular aperture through the drawbar, such that the flat wall of the bearing block will function to maintain the concave surface of the bearing block biased against the pivot pin.

As in other slackless drawbar designs, a gravity activated, slack adjusting wedge is disposed between a rear support block and a forward end surface of the cavity in the support housing which is adapted to bias the rear support block against the convex partial hemispherical buff load bearing surface of the drawbar.

OBJECTS OF THE INVENTION

It is, therefore, one of the primary objects of the present invention to provide a new and improved support housing for use in railway drawbar assemblies.

Another object of the present invention is to provide a new and improved support housing for use in railway drawbar assemblies which is adapted to receive a spool structure that permits pivotal movement of the spool structure in a defined plane perpendicular to the pivotal plane of the drawbar on the drawbar pivot pin.

Still another object of the present invention is to provide a new and improved support housing which is adapted to receive a spool structure, and in combination with the spool structure within which a drawbar is pivotally secured, will function like a universal joint to permit pivotal movement of the drawbar in any direction.

In addition to the above-identified objects and advantages of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 1:
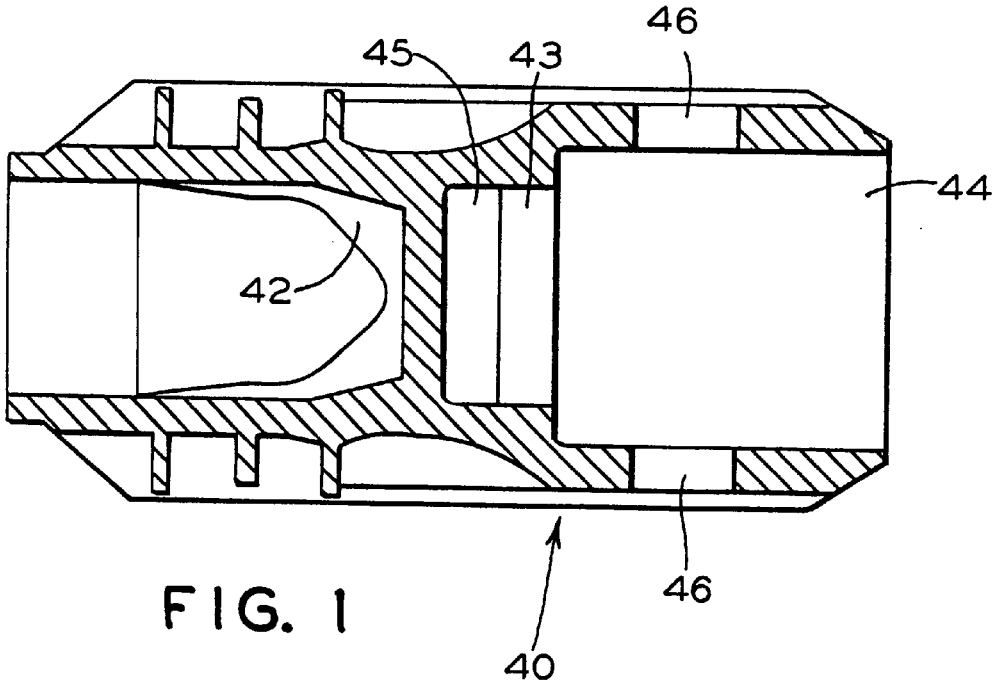
FIG. 1 is a cross-sectional plan view of a support housing for supporting a slackless drawbar assembly in accordance with a presently preferred embodiment of this invention.
Figure 2:
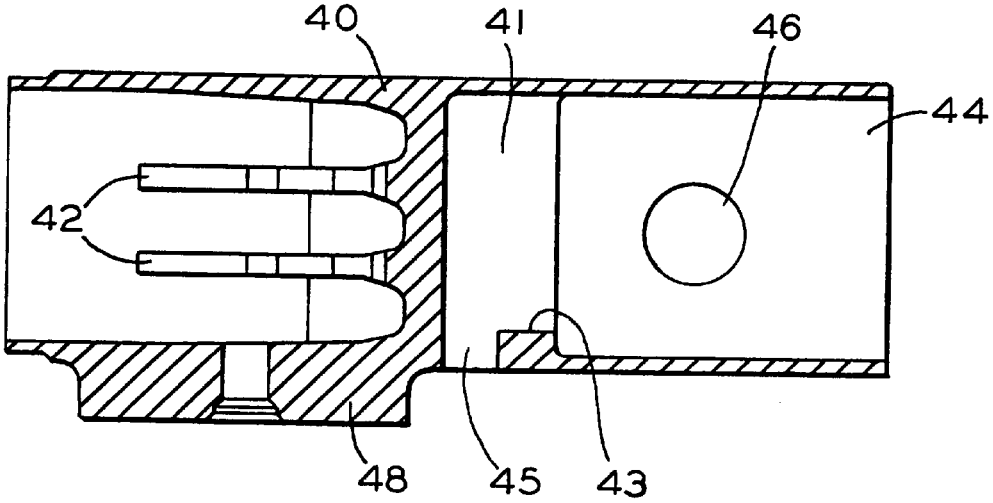
FIG. 2 is a cross-sectional side view of the support housing illustrated in FIG. 1.

Prior to proceeding with a more detailed description of the invention it should be noted that, for the sake of clarity, identical components having identical functions have been identified with identical reference numerals throughout the several views of the drawings.

Figure 5:
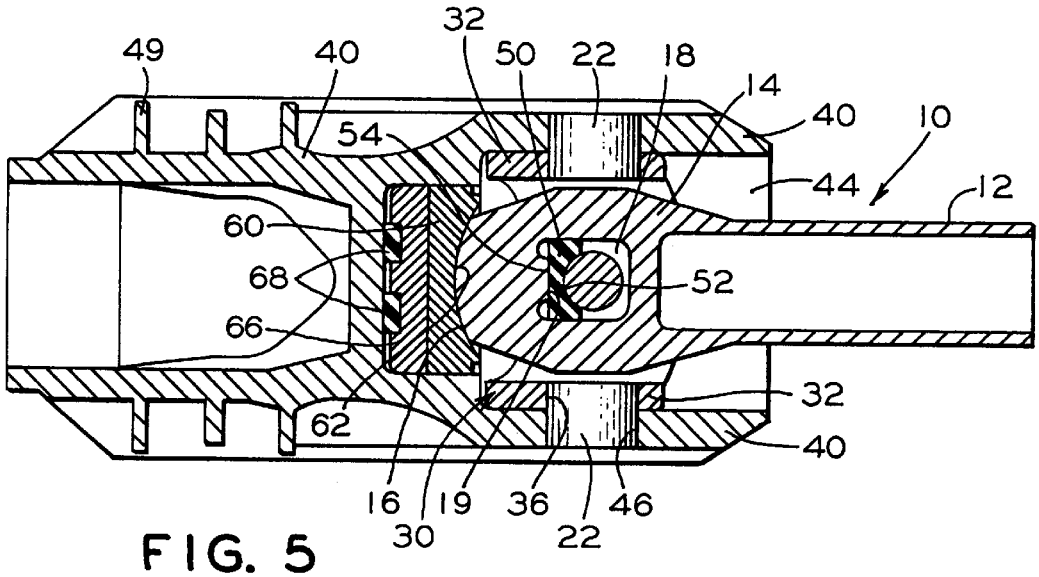
FIG. 5 is a cross-sectional plan view of the unique slackless drawbar assembly to which this invention relates which includes the support housing.
Figure 6:
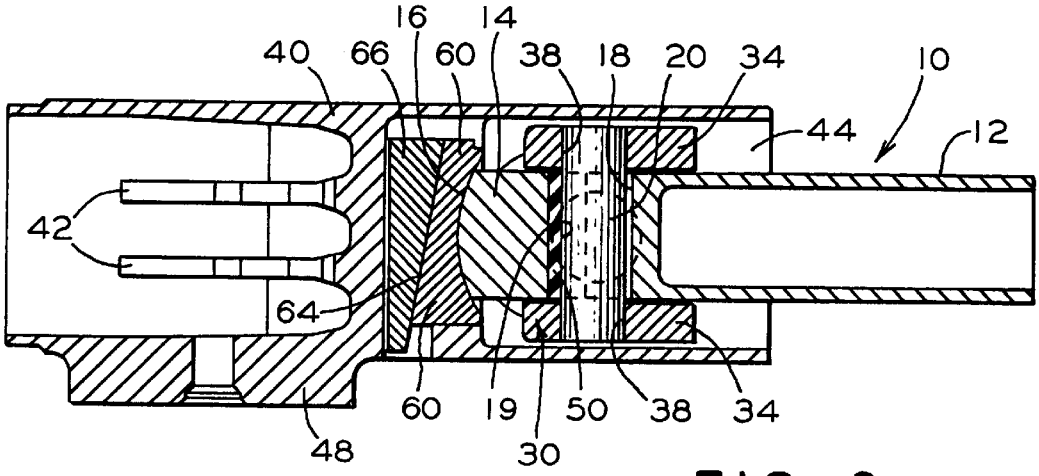
FIG. 6 is a cross-sectional side view of the assembly as illustrated in FIG. 5.

Before considering the unique and inventive support housing of this invention, a complete understanding of the unique drawbar assembly would be helpful. Accordingly, reference to FIGS. 5–6 will illustrate the unique slackless drawbar assembly to which the support housing of this invention is related, wherein a presently preferred embodiment of the assembly comprises an elongated drawbar 10 having a shank portion 12 extending to an enlarged truncated butt end portion 14, defining essentially a convex, partial hemispherical buff load bearing surface 16, and having a generally rectangular aperture 18 at the axis of said hemispherical buff load bearing surface 16. As can be seen, the shank portion 12 projects forwardly from the convex, partial hemispherical buff load bearing surface 16. While the drawbar 10 is shown to be rectangular in cross-section, other cross-sectional forms would work as well. Although the buff load bearing surface 16 is hemispherical, it is clear that it is not a full hemisphere, in that it is limited by the rectangular side edges of the drawbar 10. Accordingly, while a fuller hemispherical form could be utilized if desired, such would merely add unnecessary weight and mass to the drawbar 10.

Figure 3:
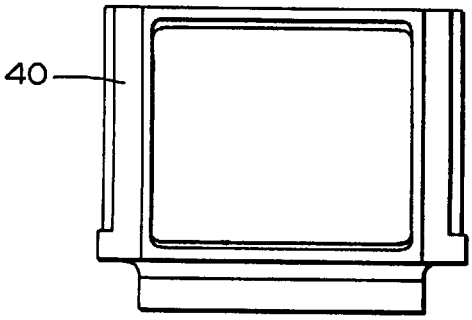
FIG. 3 is an end view of the support housing as illustrated in FIGS. 1 and 2.
Figure 4:
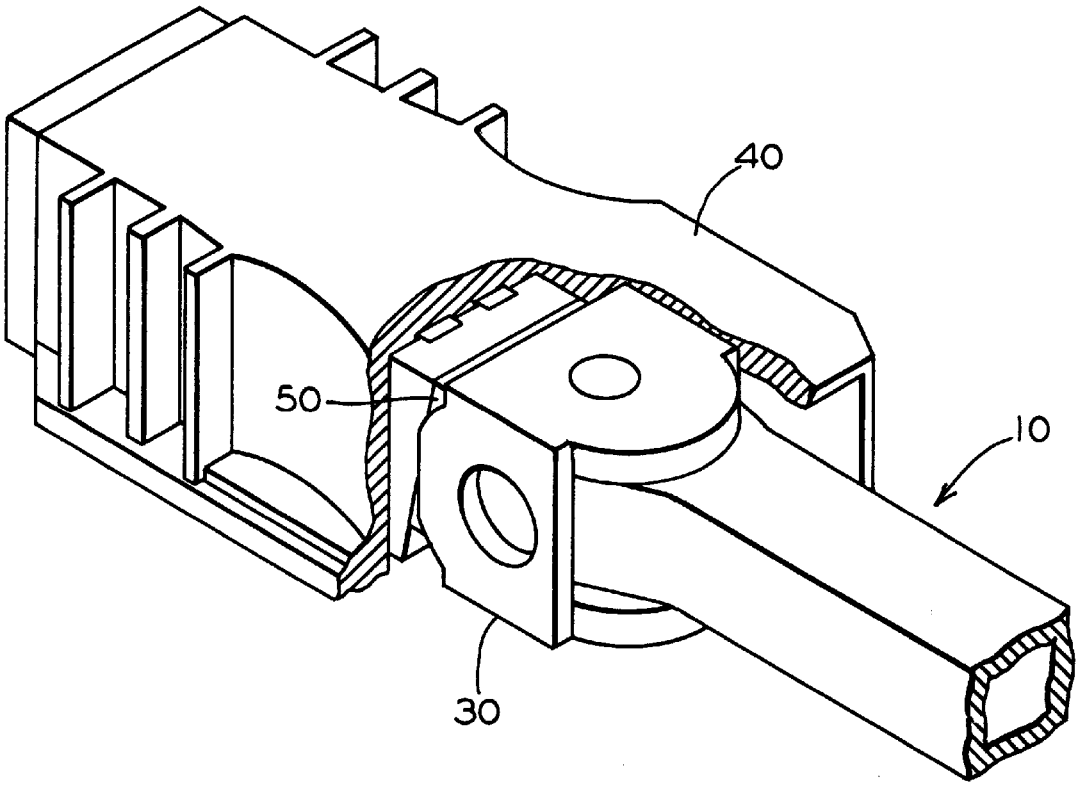
FIG. 4 is a partial cut-away isometric view of the support housing illustrated in FIGS. 1–3, which further shows the relationship of the support housing to the drawbar and other components of the drawbar assembly.

A unique spool 30 is provided for supporting an end of drawbar 10, which spool 30 comprises a generally rectangular sleeve-like body having a first pair of parallel side wall members 32 vertically extending from a second pair of parallel, horizontally disposed top and bottom wall members 34. Hence, wall members 32 and 34 essentially define a box-like sleeve body with both horizontal ends open, into which an end of drawbar 10 is inserted. A first pair of axially aligned apertures 36 are disposed through the first pair of parallel, vertically disposed, side wall members 32 each of which is adapted to receive an interlocking disk member 22 for pivotally connecting spool 30 to a support housing 40 described below. A second pair of axially aligned apertures 38 are disposed in the second pair of parallel, horizontally disposed, top and bottom wall members 34, which are adapted to receive a drawbar pivot pin 20. As shown in the FIG. 3 cross-section, the inside intersecting corners of wall members 32 and 34 are preferably rounded out to assure a flat surface that will not cause binding of edges of drawbar 10 as it pivots within spool 30, as well as preventing any stress risers that would result at an otherwise rectangular intersection.

The above described drawbar 10 is secured within spool 30 by inserting the butt end portion 14 through the rearward rectangular opening of spool 30 such that rectangular aperture 18 through drawbar 10 will be aligned with apertures 38 extending through the parallel, horizontally disposed, top and bottom wall members 34 on spool 30. Accordingly, drawbar pivot pin 20, inserted within aligned apertures 38, will also extend through rectangular aperture 18 in drawbar 10.

Drawbar 10 is pivotally secured to pivot pin 20 by a bearing block 50 having a concave, half-cylindrical surface 52 on one side, adapted to engage against a side of drawbar pivot pin 20, and a generally flat surface 54 on the opposite side, which is disposed within generally rectangular aperture 18, such that generally flat surface 54 is disposed against a flat forward surface 19 of rectangular aperture 18, to thereby bias half cylindrical surface 52 against drawbar pivot pin 20. As can be seen, the outward corners of aperture 16 in drawbar 10 are preferably rounded out to assure a perfectly flat surface 19 is provided against which bearing block 50 is to be abutted, as well as avoiding the creation of any stress risers at the corners.

A rear support block or follower 60, having a concave, hemispherical, buff load bearing surface 62 on one side, opposite a flat angled surface 64 on the other side, is vertically disposed within rectangular cavity 44 of support housing 40, such that concave, hemispherical buff load bearing surface 62 is engaged against convex, hemispherical buff load bearing surface 16 on drawbar 10. As in many comparable prior art drawbar assemblies, a gravity activated, slack adjusting wedge 66 is disposed between a rear end wall of rectangular cavity 44 and the adjacent angled surface 64 of rear support block 60. Accordingly, gravitational forces tending to pull gravity wedge 66 downwardly within cavity 44 will serve to bias gravity wedge 66 against rear support block 60, and accordingly bias concave, hemispherical buff load bearing surface 62 against its convex counter part on drawbar 10.

Preferably, gravity wedge 66 is provided with a biasing surface of an elastomeric material, which as shown, preferably comprises a pair of elongated elastomeric strips 68 vulcanized within a pair of vertical recesses on the rearward facing surface of gravity wedge 66, such that the elastomeric strips will be in contact with the flat end wall of rectangular cavity 44.

This invention is predicated on the unique support housing as adapted to support the entire drawbar assembly, which is securable to the center sill (not shown) of a railway car (not shown) by any technique such as welding. The support housing 40 is provided with elongated reinforcing ribs 42 behind a rectangular cavity 44 in the outer end thereof, which cavity 44 is adapted to receive and pivotally retain spool 30. The dimensions of cavity 44 must be sufficient to contain spool 30 and to permit some pivotal movement of spool 30 in a vertical plane. Cavity 44 is provided with a pair of axially aligned apertures 46 in the vertical side walls which apertures 46 are aligned with the first pair of axially aligned apertures 36 disposed in the first pair of vertically disposed, parallel side wall members 32 of spool 30. As was noted above, each aperture 36 is adapted to receive an interlocking disk member 22 for pivotally connecting spool 30 to the support housing 40. Hence each interlocking disk member 22 is disposed through an aperture 46 in support housing 40 and the adjacent, mating aperture 36 in spool 30, such that spool 30 is pivotal in a vertical plane on the interlocking disk members 22. Accordingly, the two interlocking disk members 22, although spaced apart, are axially aligned to function as would a single pin. As can be seen by contrasting FIGS. 5 and 6, the side wall of cavity 44 are closely spaced, but not so closely spaced as to prevent vertically disposed, wall members 34 on spool 30 from pivotal movement on disk members 22. The top and bottom side walls of cavity 44 are spaced significantly more to permit some pivotal movement of wall members 32 on spool 30, otherwise, spool 30 would not be pivotal on such members 22. Although not material for the purposes of this invention, support housing 40 is further provided with cylindrical center plate 48 protruding downwardly form the underside to which a truck (not shown) can be rotatably attached, and a plurality of laterally extending vertical flanges 49, which are utilized to facilitate welding of the support housing 40 to the car structure.

In addition to the above, the forward inner end of cavity 44 is provided with a recess cavity portion 41 adapted to receive gravity activated, slack adjusting wedge 66 and rear support block 60. As shown, the outer edge of recess cavity 41 provides a ledge 43 on the floor portion for the purpose of supporting rear support block 60, while the adjacent innermost portion is cut away to provide a slot 45 through which wedge 66 can fall to the extent necessary.

While a presently preferred embodiment of the present invention has been described in detail above, it should be understood that persons skilled in the art may make various other modifications and adaptations of the invention without departing from the spirit or scope of the appended claims. For example, in the embodiment shown, spool 30 is mounted on horizontally disposed disk pins 22 for rotation in a vertical plane. If preferred, spool 30 could be mounted for pivotal movement in a horizontal plane, or any other plane as long as the drawbar 10 were mounted within spool 30 to pivot in a plane perpendicular thereto. Obviously, a great number of other modifications and embodiments could be devised without departing from the spirit of the invention.

We claim:

1. A support housing for supporting a slackless drawbar coupler assembly within a center sill of a railway car, wherein the slackless drawbar assembly includes a spool having a drawbar pivotally pinned therein for pivotal rotation in a first pivotal plane, said support housing comprising; a generally rectangular three-dimensional body having each of a predetermined length, a predetermined width, and a predetermined height, said generally rectangular body further having a generally rectangular, three-dimensional, cavity in a rearward surface, adapted to receive such a spool, said rectangular cavity forming at least one pair of generally parallel wall portions, and means within said cavity for pivotally supporting said spool for pivotal rotation within said cavity in a second pivotal plane perpendicular to said first pivotal plane of such spool.

2. A support housing for supporting a slackless drawbar coupler assembly, according to claim 1, wherein said means for pivotally supporting said spool comprises, a pair of opposed and axially aligned apertures through said at least one pair of generally parallel wall portions of said cavity, each said aperture adapted to receive a disk pin insertable therethrough and also insertable through one each of a second pair of opposed and axially aligned apertures through parallel walls of such spool, such that said spool is pivotal within said cavity on said axially aligned disk pins.

3. A support housing for supporting a slackless drawbar coupler assembly, according to claim 1, wherein said cavity is generally rectangular having two pair of parallel and perpendicular wall portions, and said means for pivotally supporting said spool comprises, a pair of opposed, and axially aligned apertures through one each of a pair of generally parallel wall portions of said cavity, each said aperture adapted to receive a disk pin insertable therethrough and also insertable through one each of a second pair of opposed and axially aligned apertures through parallel side walls of such spool, such that said spool is pivotal within said cavity on said axially aligned disk pins.

4. A support housing for supporting a slackless drawbar coupler assembly, according to claim 1 wherein said cavity includes a recessed cavity portion adapted to receive a gravity activated, slack adjusting wedge and rear support block.

5. A support housing for supporting a slackless drawbar coupler assembly, according to claim 4, wherein said recessed cavity portion includes a ledge on a floor portion adapted to support a rear support block abutting against an end of such drawbar.

6. A support housing for supporting a slackless drawbar coupler assembly, according to claim 5, wherein said recessed cavity portion includes a slot portion adjacent to said ledge adapted to permit such gravity activated, slack adjusting wedge to fall to the extent necessary.

7. A support housing for supporting a slackless drawbar coupler assembly, according to claim 1, in which said support housing further includes flanges extending from side surfaces for the purpose of facilitating welding of said support housing to a car structure.

8. A support housing for supporting a slackless drawbar coupler assembly, according to claim 1, in which said support housing further includes a cylindrical center plate protruding downwardly from the underside adapted to receive a railway truck.

9. A support housing for supporting a slackless drawbar coupler assembly within a center sill of a railway car, wherein the slackless drawbar assembly includes a spool having a drawbar pivotally pinned therein for pivotal rotation in a first pivotal plane, said support housing comprising; a generally rectangular three-dimensional body having each of a predetermined length, a predetermined width, and a predetermined height, said generally rectangular body further having a generally rectangular, three-dimensional, cavity in an underside surface, adapted to receive such spool, said rectangular cavity forming a pair of generally parallel side wall portions spaced by a top and bottom wall portion, said side wall portions having aligned and opposed apertures adapted to receive a disk pin insertable therethrough and also insertable through one each of a second pair of opposed and axially aligned apertures through parallel side walls of such spool, such that said spool is pivotal in a vertical plane within said cavity on such axially aligned disk pins.

10. A support housing for supporting a slackless drawbar coupler assembly, according to claim 9, wherein said cavity includes a recessed cavity portion adapted to receive a gravity activated, slack adjusting wedge and rear support block.

11. A support housing for supporting a slackless drawbar coupler assembly, according to claim 10, wherein said recessed cavity portion includes a ledge on a floor portion adapted to support a rear support block abutting against an end of such drawbar.

12. A support housing for supporting a slackless drawbar coupler assembly, according to claim 11, wherein said recessed cavity portion includes a slot portion adjacent to said ledge adapted to permit such gravity activated, slack adjusting wedge to fall to the extent necessary.

13. A support housing for supporting a slackless drawbar coupler assembly, according to claim 8, in which said support housing further includes a cylindrical center plate protruding downwardly from the underside adapted to receive a railway truck.

14. A drawbar support system for supporting a pivotal drawbar within a center sill of a railway car, said drawbar support system comprising:

a) a generally rectangular spool having a first pair of parallel wall members extending from a second pair of parallel wall members, and with two open ends, a first pair of axially aligned apertures disposed in said first pair of parallel wall members, each adapted to receive an interlocking disk pin, a second pair of axially aligned apertures disposed in said second pair of wall members, adapted to receive a drawbar pivot pin;

b) a generally rectangular support housing having a generally rectangular, three-dimensional, cavity in a rearward surface, adapted to receive such a spool, said rectangular cavity forming at least one pair of generally parallel wall portions, a third pair of opposed and axially aligned apertures through said at least one pair of generally parallel wall portions of said cavity, each said third pair of aperture adapted to receive a disk pin insertable therethrough and also insertable through one each of said first pair of opposed and axially aligned apertures through said first pair of parallel walls members of said spool, such that said spool is pivotal within said cavity on said axially aligned disk pins.

15. A drawbar support system for supporting a pivotal drawbar within a center sill of a railway car, according to claim 14, in which said disk pins have an axis perpendicular to an axis of such pivot pin pinning such drawbar within said spool.

16. A drawbar support system for supporting a pivotal drawbar within a center sill of a railway car, according to claim 14, in which said cavity in said support housing includes a recessed cavity portion adapted to receive a gravity activated, slack adjusting wedge and rear support block abutting against an end of such drawbar.

17. A drawbar support system for supporting a pivotal drawbar, according to claim 16, wherein said recessed cavity portion includes a ledge on a floor portion adapted to support said rear support block abutting against an end of such drawbar.

18. A drawbar support system for supporting a pivotal drawbar, according to claim 17, wherein said recessed cavity portion includes a slot portion adjacent to said ledge adapted to permit such gravity activated, slack adjusting wedge to fall to the extent necessary.

* * * * *